US012667230B2

(12) United States Patent
Schluter

(10) Patent No.: US 12,667,230 B2
(45) Date of Patent: Jun. 30, 2026

(54) WASHBASIN, WASHBASIN ASSEMBLIES AND RELATED METHODS

(71) Applicant: Schluter Systems L.P., Plattsburgh, NY (US)

(72) Inventor: Marc Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 286 days.

(21) Appl. No.: 18/452,374

(22) Filed: Aug. 18, 2023

(65) Prior Publication Data

US 2024/0065487 A1 Feb. 29, 2024

(30) Foreign Application Priority Data

Aug. 26, 2022 (DE) ..... 202022104831.2

(51) Int. Cl.
*A47K 1/04* (2006.01)
*E03C 1/18* (2006.01)

(52) U.S. Cl.
CPC . *A47K 1/04* (2013.01); *E03C 1/18* (2013.01)

(58) Field of Classification Search
CPC ..... E03F 5/0407; E03F 5/0408; E03F 5/0409; A47K 3/40; A47K 1/04; E03C 1/14; E03C 1/18
See application file for complete search history.

(56) References Cited

U.S. PATENT DOCUMENTS

| | | | | |
|---|---|---|---|---|
| 6,618,874 | B2 | 9/2003 | Gerloff | |
| 8,181,288 | B1 * | 5/2012 | Davis, Jr. | A47K 3/40 4/679 |
| 9,596,961 | B2 * | 3/2017 | Stokely | A47K 3/02 |
| 9,745,758 | B2 * | 8/2017 | Baert | E04F 15/105 |
| 10,292,539 | B2 * | 5/2019 | Schindler | A47K 3/40 |

FOREIGN PATENT DOCUMENTS

| | | | | |
|---|---|---|---|---|
| DE | 4317853 | A1 * | 12/1993 | E03C 1/33 |
| DE | 9319156 | U1 | 3/1994 | |
| DE | 10235367 | C1 | 10/2003 | |
| DE | 102009039312 | A1 | 3/2010 | |
| DE | 202022104831 | U1 | 11/2023 | |
| IT | 201900018167 | A1 | 4/2021 | |

OTHER PUBLICATIONS

International Search Report for Application No. 202022104831.2 dated Nov. 21, 2022, 3 pages.

(Continued)

*Primary Examiner* — Erin Deery

(57) ABSTRACT

A washbasin assembly includes comprising a base body (3) with a top recess (19) having a drainage opening (15) formed therein. A surface of the top recess slopes in the direction of the drainage opening (15). The base body (3) is formed from hard foam carrying a waterproof layer (13) at least on its upwardly facing surfaces, on which in turn, an adhesion-promoting layer (14) is arranged which promotes adhesion of thin-bed mortar or filler material, the base body (3) formed from a plurality of cut-to-size rigid foam panels (8, 9, 10, 11), which are arranged one above the other and are firmly bonded to one another.

20 Claims, 4 Drawing Sheets

(56) References Cited

OTHER PUBLICATIONS

Lux Elements, Lux Elements Lavado-Float, Installation instructions & processing guidelines, retrieved from https://www.luxelements.com/lux_en/pdf/index_montage.htm (Jan. 2022), 20 pgs.
Wedi, Sanbath wash basin, Assembly instructions wedi Sanbath foating wash basin with channel, retrieved from https://www.wedi.net/en/products/design-line/sanbath-wash-basin/ , 4 pgs.

* cited by examiner

WASHBASIN, WASHBASIN ASSEMBLIES AND RELATED METHODS

PRIORITY CLAIM

Priority is claimed of and to German Patent Application Serial No. 20 2022 104 831.2, filed Aug. 26, 2022, which is hereby incorporated herein by reference in its entirety.

BACKGROUND OF THE INVENTION

Field of the Invention

The present invention relates to washbasin systems and methods for manufacturing and configuring washbasins.

SUMMARY OF THE INVENTION

In accordance with one embodiment, a washbasin assembly (1) is provided, including a base body (3) with a top recess (19) having a drainage opening (15) formed therein. A surface of the top recess can slope in the direction of the drainage opening (15). The base body (3) can be formed from hard foam carrying a waterproof layer (13) at least on its upwardly facing surfaces, on which in turn, an adhesion-promoting layer (14) is arranged which promotes adhesion of thin-bed mortar or filler material. The base body (3) can be formed from a plurality of cut-to-size rigid foam panels (8, 9, 10, 11), which are arranged one above the other and are firmly bonded to one another.

In accordance with another aspect of the technology, a method of forming a washbasin base body (3) is provided. The method can include arranging a plurality of cut-to-size rigid foam panels (8, 9, 10, 11) one above the other and firmly bonding one to another. The resultant base body (3) can thereby have a top recess (19) having a drainage opening (15) formed therein. A surface of the top recess can slope in the direction of the drainage opening (15). The resultant base body (3) can be formed from hard foam carrying a waterproof layer (13) at least on its upwardly facing surfaces, on which in turn, an adhesion-promoting layer (14) is arranged which promotes adhesion of thin-bed mortar or filler material.

In accordance with another aspect of the technology, a washbasin assembly (1) can be provided, including a base body (3) formed from at least four cut-to-size rigid foam panels. The foam panels can include at least a lower rigid foam panel (8), a first supporting rigid foam panel (9) arranged atop the lower rigid foam panel, a second supporting rigid foam panel (10) arranged atop the second supporting rigid foam panel, and an upper rigid foam panel (11). The upper rigid foam panel (11) can include an angled panel (22) section that extends through the first supporting rigid foam panel (9) and through the second supporting rigid foam panel (10) to the lower rigid foam panel (8).

BRIEF DESCRIPTION OF THE DRAWINGS

The same reference numbers relate hereafter to identical or similar components or component ranges.

DETAILED DESCRIPTION

Figure 1:
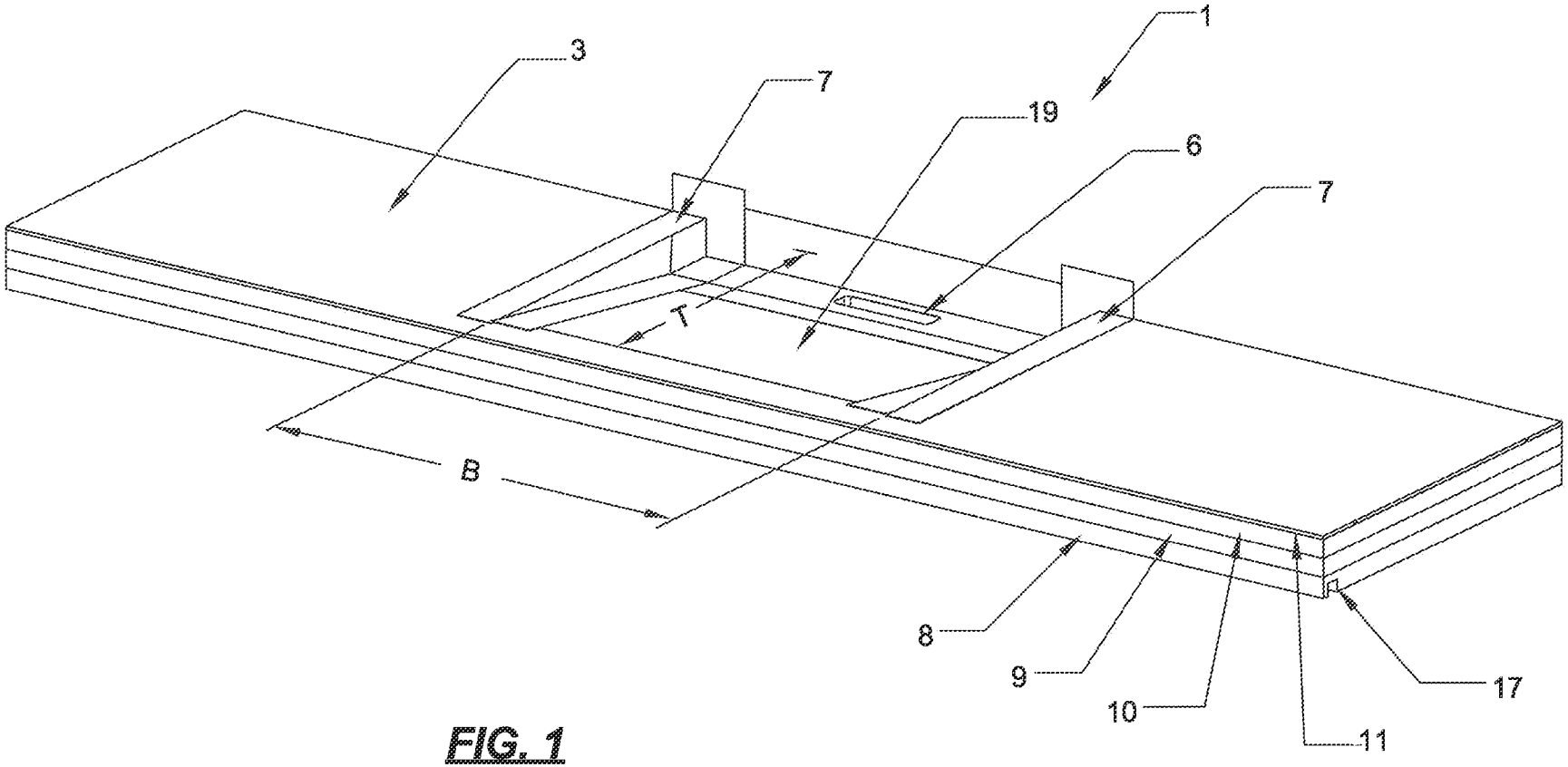
FIG. 1 a perspective view of a washbasin according to one embodiment of the present invention.
Figure 2:
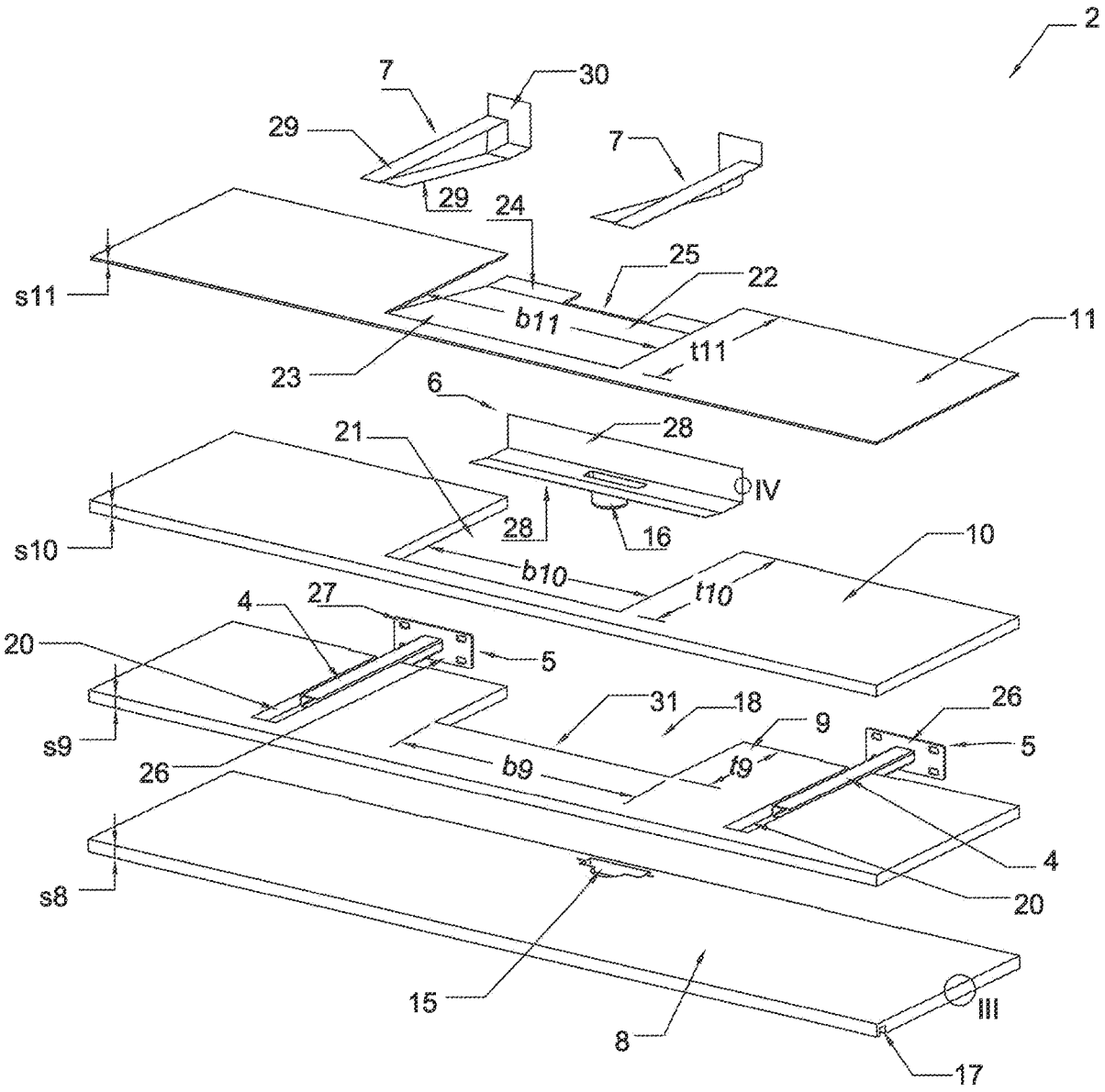
FIG. 2 an exploded view of the washbasin shown in FIG. 1.
Figure 3:
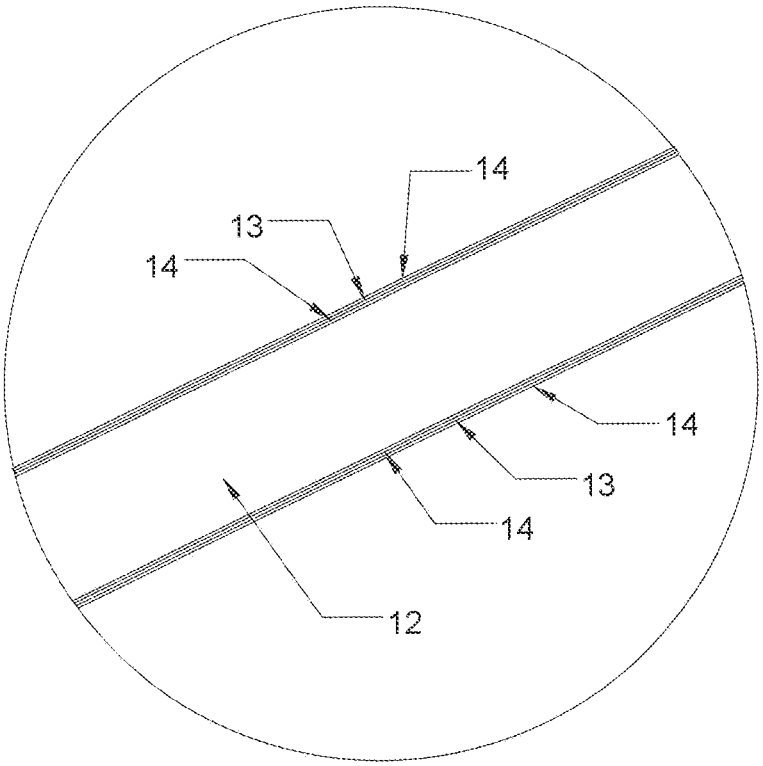
FIG. 3 an enlarged view of the section marked with reference HI in FIG. 2.

Reference will now be made to the exemplary embodiments illustrated in the drawings, and specific language will be used herein to describe the same. It will nevertheless be understood that no limitation of the scope of the invention is thereby intended, Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a panel" can include one or more of such panels, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. Generally, directional terms used in this application, such as "top" or "bottom" refer to the installed state. The formulations "substantially vertical" and "substantially horizontal" are to be construed such that the main extension direction is vertical and horizontal, respectively.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates to a kit for the manufacture of a washbasin, comprising a base body with a top recess, the bottom of which forms a slope in the direction of a drainage opening formed in the recess, wherein the base body comprises hard foam and is provided with a waterproof layer at least on its upwardly facing surfaces, on which in turn, in particular directly, an adhesion-promoting layer is arranged, which promotes adhesion of thin-bed mortar or filler material, in particular concrete filler. Furthermore, the invention relates to a washbasin made from such a kit.

Kits for the manufacture of a washbasin are known in the prior art. The products "LAVADO-FLOAT L" from Lux Elements GmbH & Co KG and "Sanbath" from WEDI GmbH are merely examples. These kits comprise a base body, which is provided with a top recess, the bottom of which forms a slope in the direction of a drain opening formed in the recess. The base body is made of a single block of rigid foam in which the recess, including the slope, is milled. Apart from the rear side, the main outer surfaces are provided with a mineral coating which acts as an adhesion-promoting layer to promote adhesion of thin-bed mortar or filler material. Accordingly, the washbasins can be filled or tiled after installation.

Based on this prior art, it is an object of the present invention to create a kit for the manufacture of a washbasin as well as a washbasin of the aforementioned type with an alternative structure.

To solve this object, the present invention provides a kit for the manufacture of a washbasin, comprising a base body with a top recess, the bottom of which forms a slope in the direction of a drainage opening formed in the recess, wherein the base body comprises hard foam and is provided with a waterproof layer at least on its upwardly facing surfaces, on which in turn, in particular directly, an adhesion-promoting layer is arranged, which promotes adhesion of thin-bed mortar or filler material, in particular concrete filler, the base body having a plurality of cut-to-size rigid foam panels, which are arranged one above the other and are firmly bonded to one another.

A significant advantage of the kit according to the invention is that the base body is made from a plurality of cut rigid foam panels. The cutting of the individual rigid foam panels does not require a milling machine, which avoids machine acquisition costs if appropriate cutting tools for cutting rigid foam panels are already available. In addition, the structure of the base body can be designed variably thanks to the cutting of the individual panels. Even though rigid foam panels are basically water-repellent, they can warp when exposed to moisture. In order to prevent such warping, the base body according to the invention is provided with a waterproof layer at least on its upward-facing surfaces which are exposed to water during subsequent use of the washbasin. On the waterproof layer there is in turn arranged, in particular directly, an adhesion-promoting layer which promotes adhesion of thin-bed mortar or filler material, in particular concrete filler, in order to be able to coat the base body with filler material or cover it with tiles after it has been installed, despite the waterproof layer.

Preferably, the waterproof layer is a plastic film, for example made of polyethylene.

The adhesion-promoting layer is advantageously a fleece or fabric to which thin-bed mortar or filler material can adhere well.

According to one embodiment of the present invention, an adhesion-promoting layer is arranged directly below and above the waterproof layer. Such a three-layer structure comprising an adhesion-promoting layer, a waterproof layer and an adhesion-promoting layer can be produced, for example, by laminating or thermally fixing a fabric or nonwoven fabric on both sides of a plastic film. The lower adhesion-promoting layer is used to attach the waterproof layer to the base body. For example, the rigid foam can be foamed directly onto the adhesion-promoting layer during production of the top building panel. Alternatively, of course, bonding or fastening using a thermal process is also conceivable.

The bottom of the recess is advantageously formed by a downwardly angled panel section of an upper rigid foam panel, in particular the uppermost rigid foam panel. In this way, a simple structure is achieved.

According to one embodiment of the present invention, at least the side walls of the recess are covered with, in particular, cut-to-size and preformed sealing film elements which are provided with an adhesion-promoting layer at least on their outwardly facing surface, in particular on both surfaces, the sealing film elements each preferably having a sealing film section facing the rear side of the base body and, in particular, terminating flush with the rear side of the base body. The sealing film from which the sealing film elements are made may in turn be a plastic film, for example made of polyethylene. The adhesion-promoting layer is preferably formed from a fabric or nonwoven. The sealing foil section facing the back of the base body serves to seal against a room wall on which the washbasin is later mounted.

The rigid foam panel forming the bottom of the recess can have a sheet thickness in the range from 2 to 10 mm, in particular in the range from 4 to 7 mm. A comparatively low panel thickness is conducive to the formation of the angled panel section.

Advantageously, immediately below the rigid foam panel forming the bottom of the recess is arranged a rigid foam panel which has a greater sheet thickness than the rigid foam panel forming the bottom of the recess, in particular a sheet thickness in the range from 15 to 35 mm, more preferably in the range from 20 to 25 mm, wherein the rigid foam panel arranged below the rigid foam panel forming the bottom of the recess has below the angled panel section a recess extending from the rear edge of the panel, the width of which recess can be greater than or equal to (or slightly less than)

the width of the angled panel section and the depth of which recess corresponds to the depth of the angled panel section.

A rigid foam panel can be arranged below that rigid foam panel which is arranged below the rigid foam panel forming the bottom of the recess has a recess extending from the rear edge of the panel, the width of which corresponds to the width of the angled panel section, and the depth of which is less than the depth of the angled panel section, so that the underside of the angled panel section rests on the hard foam panel arranged below it.

In accordance with one embodiment of the present invention, it has one or more wall mounting brackets for fastening the washbasin to a wall, which wall mounting brackets form at least two forwardly projecting swords, and in that a central rigid foam panel is provided with at least two parallel, elongated sword-receiving recesses extending forwardly from the rear panel edge.

At least the uppermost and the lowermost rigid foam panel can each include a rigid foam core, waterproof layers arranged on both sides of the rigid foam core and adhesion-promoting layers positioned on the opposite outer sides. The applicant seas such a building board, for example, under the product name Schlüter KERN-BOARD.

Furthermore, the present invention provides a washbasin for solving the above-mentioned object, which is characterized in that it is manufactured from or provided as a kit according to the invention.

The figures show a washbasin assembly 1 according to one embodiment of the present invention and a kit or assembly 2 for manufacturing the same. The washbasin 1 can include a top recess 19 with a width B and a depth T. The kit 2 for manufacturing the washbasin 1 can include as main components a base body 3, which forms the actual basin, two wall mounting brackets 5, each having a sword 4, which are designed for fastening the washbasin 1 to a wall of a room, a drainage device 6 and two sealing film elements 7.

The base body 3 can be formed primarily of rigid foam, more specifically of a plurality of cut-to-size rigid foam panels 8, 9, 10 and 11, which are arranged one above the other and firmly bonded to one another. In one embodiment, the rigid foam is extruded rigid polystyrene foam (MCPS), although other rigid foams are of course also possible. The individual rigid foam panels 8, 9, 10 and 11, which each have a uniform sheet thickness s when considered separately, are basically cut to a substantially rectangular shape. However, it should be clear that other cuts are also possible, for example a square cut, a cut with roundings in the edge regions, a free-form cut or the like, whereby the respective rear panel edge of the rigid foam panels 8, 9, 10 and 11 can be designed to be essentially rectilinear in order to enable fastening to a flat room wall.

The lowermost rigid foam panel 8, or lower rigid foam panel, can include a rigid foam core 12 which is coated on both sides with a layered composite which in each case has an adhesion-promoting layer 14, a waterproof layer 13 and again an adhesion-promoting layer 14. Plastic films, such as polyethylene films, are preferred as waterproof layers 13. The adhesion-promoting layers 14 are presently in the form of a nonwoven. Alternatively, however, a fabric layer can also serve as the adhesion-promoting layer 14, for example. The plate thickness s8 is in the range from 25 to 35 mm, but is in principle freely selectable. In the rear area near the rear edge of the panel, a drainage opening 15 is formed, the shape of which is adapted to the shape of a drain 16 of the drainage system 6. The underside of the lowermost rigid foam panel 8 is provided in the front region with a continuous groove 17 extending substantially parallel to the front panel edge, into which a light source can be inserted, for example in the form of an LED strip or the like. It should be clear that the groove 17 can of course also be dispensed with.

The rigid foam panel 9 arranged above it, sometimes referred to herein as the first supporting rigid foam panel, can consist of a rigid core 12, but it can also be provided with waterproof layers 13 and adhesion-promoting layers 14 in the same way as the lowest rigid foam panel 8. The rigid foam panel 9 has a central rectangular recess 18, the width of which can correspond to the width B of an upper recess 19 of the washbasin 1. However, the depth t is somewhat less than the depth T of the recess 19. Furthermore, the rigid foam panel 9 comprises sword-receiving recesses 20 arranged on both sides of the central recess 18, which extend parallel to one another from the rear panel edge to the front and are adapted to the dimensions of the swords 4 of the wall mounting brackets 5. The panel thickness s9 is 25 mm, or whichever panel thickness s9 can correspond to the height of the swords 4 in order to ensure a secure hold.

The next rigid foam panel 10, sometimes referred to herein as the second supporting rigid foam panel, the basic structure of which can correspond to the lowest or second-lowest rigid foam panel 8, 9, also has a central, rectangular recess 21, the width b10 and depth t10 of which correspond essentially to the width B and depth T of the recess 19. The panel thickness s10 can be in the range of 20 to 25 mm.

The uppermost rigid foam panel 11, or upper rigid foam panel, the basic structure of which corresponds to that of the lowermost rigid foam panel 8, has a downwardly angled panel section 22, the width b11 and depth t11 of which correspond essentially to those of the recess 21. A front section 23 of the angled panel section can form the slope of the bottom of the recess 19, and a rear section 24 can form an insertion region for the drainage device 6. For this purpose, the rear section 24 can also be provided with a recess 25. The plate thickness s11 can be from about 2 mm to about 10 mm. In one example, the thickness s11 is about 5 mm.

The wall mounting brackets 5, which are preferably made of metal, can each have, in addition to the swords 4, a plate-shaped mounting section 26 from which the swords 4 project and which are each provided with four holes 27 for the passage of screws. It should be clear that instead of two wall mounting brackets 5, a single wall bracket with two swords can also be used.

The drainage device 6 can be designed in the present case as a line drainage and can have a sealing tape 28 along its front and upper rear edge in each case. The sealing tapes 28 can each be made of a layered structure which, viewed from top to bottom, has an adhesion-promoting layer 14, in particular of fabric or nonwoven, a waterproof layer 13, in particular of plastic film, and again an adhesion-promoting layer 14.

The present cut-to-size and preformed sealing film elements 7 serve to cover the side walls of the recess 19 and are shaped accordingly. The sealing film elements 7 each comprise overlap sections 29 for covering the base body regions arranged adjacent to the side walls of the recess 19 and a sealing film section 30 facing the rear side of the base body 3, in particular flush with the rear side of the base body 3, which serves as a transition to a wall seal. The basic structure of the sealing film elements 7 corresponds in the present case to the structure of the sealing tapes 28 of the drainage device.

In one example, to assemble the wash basin 1, in a first step the bottom two rigid foam panels 8 and 9 are arranged flush one above the other and fastened to one another, for example glued together. In a second step, the third rigid foam panel 10 is arranged on the second rigid foam panel 9 and fastened to it. Then the drainage device 6 is inserted from above into the drainage opening 15 of the lowermost rigid foam panel 8 and the front sealing tape 28 is bonded in a sealing manner to the upper bonding layer 14 of the lowermost rigid foam panel 8. Now the uppermost rigid foam panel 11 is placed on the third rigid foam panel 10 and fastened to it. After a portion of the foam panel 11 is attached to the second supporting panel 10, the panel section 22 can flex slightly relative to the otherwise bonded portion. Then, the panel section 22 of the uppermost rigid foam panel 11 can be pressed down until it rests on the edge, designated by the reference numeral 31, of the underlying rigid foam panel 9, whereupon the underside of the rear section 24 of the panel section 22 is sealingly bonded to the upper adhesion-promoting layer 14 of the lowermost rigid foam panel 8. In a final step, the sealing film elements 7 are adhesively fixed in the area of the side walls of the recess 19.

The arrangement thus produced can now be slid onto the swords 4 of the wall mounting brackets 5 fastened to a room wall. The surfaces of the base body 3 can then be filled with a filler material or covered with tiles. A light fixture can be inserted into the groove 17 to improve the external appearance, particularly in the form of an LED strip.

Figure 4:
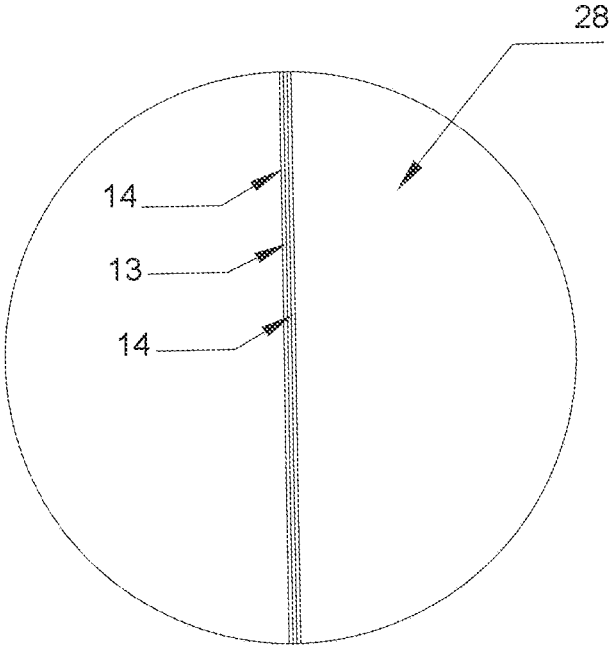
FIG. 4, an enlarged view of the section marked with reference IV in FIG. 2.
Figure 5:
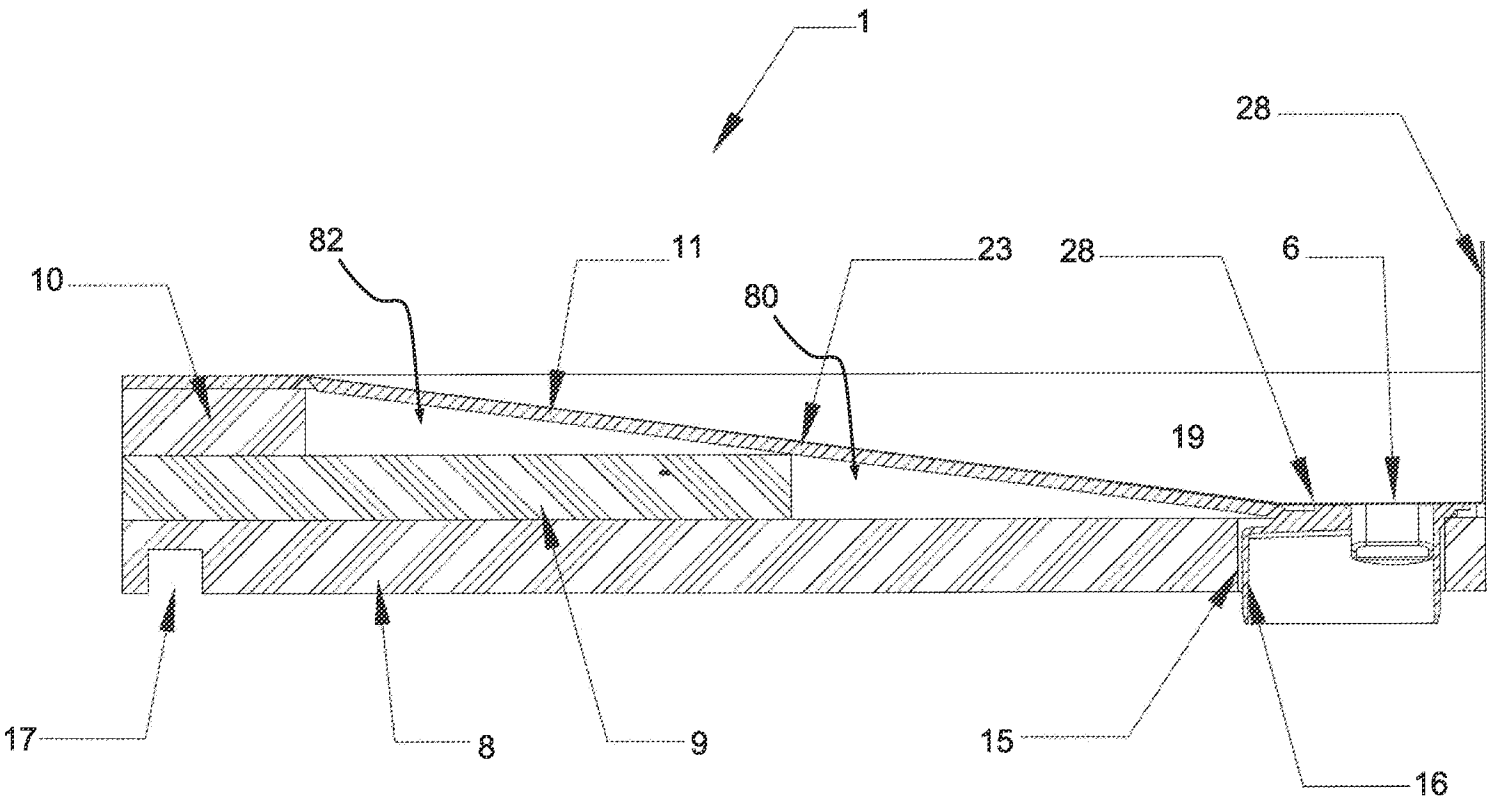
FIG. 5 a sectional view of the wash basin shown in FIG. 1.

As shown in the sectional view of FIG. 4, once the panel section 22 is positioned so as to contact the lower rigid foam panel 8, an open space 80 is defined between the panel 22 and the lower panel 8. The panel 22 contacts an edge of the first supporting panel 10, and a second open space 82 is defined between the first supporting panel 10 and the panel 22. The panel 22 can rest flush against the portion of the second supporting panel 10, as shown.

EXAMPLE EMBODIMENTS

The following examples pertain to specific technology embodiments and point out specific features, elements, or steps that can be used or otherwise combined in achieving such embodiments.

In one example, there is provided a kit (2) for the manufacture of a washbasin (1), comprising a base body (3) with a top recess (19), the bottom of which forms a slope in the direction of a drainage opening (15) formed in the recess (19), wherein the base body (3) comprises hard foam and is provided with a waterproof layer (13) at least on its upwardly facing surfaces, on which in turn, in particular directly, an adhesion-promoting layer (14) is arranged, which promotes adhesion of thin-bed mortar or filler material, in particular concrete filler, the base body having a plurality of cut-to-size rigid foam panels (8, 9, 10, 11), which are arranged one above the other and are firmly bonded to one another.

The kit can be characterized in that the waterproof layer (13) is a plastic film. The adhesion-promoting layer (14) can be a fleece or fabric. An adhesion-promoting layer (14) can be arranged directly below and above the waterproof layer (13). The bottom of the recess (19) can be formed by a downwardly angled panel section (22) of an upper rigid foam panel (11), in particular the uppermost rigid foam panel. At least the side walls of the recess (19) can be covered with, in particular, cut-to-size and preformed sealing film elements (7) which can be provided with an adhesion-promoting layer (14) at least on their outwardly facing surface, in particular on both surfaces, the sealing film elements (7) each having a sealing film section (30) facing the rear side of the base body (3) and, in particular, terminating flush with the rear side of the base body (3). The rigid foam panel (11) forming the bottom of the recess (19) can have a sheet thickness (s11) in the range from 2 to 10 mm, in particular in the range from 4 to 7 mm. The kit can be characterized in that immediately below the rigid foam panel (11) forming the bottom of the recess (19) can be arranged a rigid foam panel (10) which has a greater sheet thickness (s10) than the rigid foam panel (11) forming the bottom of the recess (19), in particular a sheet thickness (s10) in the range from 15 to 35 mm, or in the range from 20 to 25 mm, wherein the rigid foam panel (10) arranged below the rigid foam panel (11) forming the bottom of the recess (19) has below the angled panel section (22) a recess (21) extending from the rear edge of the panel, the width (b10) of which recess corresponds to the width (b11) of the angled panel section (22) and the depth (t10) of which recess corresponds to the depth (t11) of the angled panel section (22).

A rigid foam panel (9) can be arranged below that rigid foam panel (10) which is arranged below the rigid foam panel (11) forming the bottom of the recess (19) has a recess (31) extending from the rear edge of the panel, the width (b9) of which corresponds to the width (b11) of the angled panel section (22), and the depth (t9) of which is less than the depth (t11) of the angled panel section (22), so that the underside of the angled panel section (22) rests on the hard foam panel (8) arranged below it.

One or more wall mounting brackets (5) can be provided for fastening the washbasin (1) to a wall, which wall mounting brackets (5) form at least two forwardly projecting swords (4), and a central rigid foam panel (9) can be provided with at least two parallel, elongated sword-receiving recesses (20) extending forwardly from the rear panel edge. A drainage device (6), such as a line drainage, can be provided with at least one sealing sleeve or with a plurality of sealing tapes (28) and can have a drain (16) which is designed for insertion into the drain opening (15), the sealing sleeve or the sealing tapes (28) preferably being provided with an adhesion-promoting layer (14) on their outwardly facing surfaces. At least the uppermost (11) and the lowermost rigid foam panel (8) each have a rigid foam core (12), waterproof layers (13) arranged on both sides of the rigid foam core (12) and adhesion-promoting layers (14) positioned on the opposite outer sides.

A washbasin can be provided, characterized in that it is manufactured with a kit (2) according to one of the preceding embodiments.

It will be recognized that embodiments of profile systems in accordance with the invention are not limited to the above-described embodiments, and various modifications may be possible without departing from the scope of the invention as defined in the appended claims.

REFERENCE NUMBERS

1 washbasin
2 kit
3 base body
4 sword
wall mounting bracket
6 drainage device
7 sealing film element
8 rigid foam panel, and/or lower rigid foam panel
9 rigid foam panel, and/or first supporting rigid foam panel
10 rigid foam panel, and/or second supporting rigid foam panel

11 rigid foam panel, and/or upper rigid foam panel
12 rigid foam core
13 waterproof layer
14 adhesion-promoting layer
15 drainage opening
16 drain
17 groove
18 recess
19 recess
20 sword-receiving recesses
21 recess
22 panel section
23 front section
24 rear section
25 recess
26 mounting section
27 hole
28 sealing tape
29 overlap section
30 Sealing film section
31 Edge
s panel thickness
b width
B width
t depth
T depth

The invention claimed is:

1. A washbasin assembly (1), comprising a base body (3) with a top recess (19) having a drainage opening (15) formed therein, a surface of the top recess sloping in the direction of the drainage opening (15), wherein the base body (3) includes upwardly facing surfaces formed from one (11) of a plurality of rigid foam panels, the upwardly facing surfaces carrying a waterproof layer (13) having an adhesion-promoting layer (14) arranged thereon, the adhesion-promoting layer promoting adhesion of thin-bed mortar or filler material to the upwardly facing surfaces, the base body (3) formed from a plurality of cut-to-size rigid foam panels (8, 9, 10, 11) bonded to one another.

2. The assembly (1) of claim 1, wherein the waterproof layer (13) is a plastic film.

3. The assembly (1) of claim 1, wherein the adhesion-promoting layer (14) is a fleece or fabric.

4. The assembly (1) of claim 3, further comprising a second adhesion-promoting layer (14), one of the adhesion-promoting layer and the second adhesion-promoting layer arranged directly below the waterproof layer (13) and another of the adhesion-promoting layer and the second adhesion-promoting layer arranged directly below the waterproof layer (13).

5. The assembly (1) of claim 1, wherein at least the side walls of the recess (19) are covered with cut-to-size and preformed sealing film elements (7), each sealing film element having an outwardly facing surface carrying an adhesion-promoting layer, the sealing film elements (7) each having a sealing film section (33) facing a rear side of the base body (3) and terminating flush with the rear side of the base body (3).

6. The assembly (1) of claim 1, wherein the surface of the top recess (19) is formed by a downwardly angled panel section (22) of an upper one (11) of the plurality of rigid foam panels, the upper rigid foam panel comprising an uppermost rigid foam panel of the base body (3).

7. The assembly (1) of claim 6, wherein the upper rigid foam panel (11) has a sheet thickness (s11) in the range from about 2 to about 10 mm.

8. The assembly (1) of claim 6, wherein a second (10) of the plurality of rigid foam panels having a greater sheet thickness (s10) than a sheet thickness of the upper rigid foam panel (11) is arranged immediately below the upper rigid foam panel (11).

9. The assembly (1) of claim 1, wherein the plurality of cut-to-size rigid foam panels (8, 9, 10, 11) include a bottom rigid foam panel (8), a first supporting rigid foam panel (9), a second supporting rigid foam panel (10) and an upper rigid foam panel (11).

10. The assembly (1) of claim 9, wherein a thickness (s8) of the bottom rigid foam panel (8) is greater than a thickness (s9) of the first supporting rigid foam panel (9), the thickness (s9) being greater than a thickness (s10) of the second supporting rigid foam panel (10), the thickness (s10) being greater than a thickness (s11) of the upper rigid foam panel (11).

11. The assembly (1) of claim 9, wherein the second supporting rigid foam panel (10) arranged below the upper rigid foam panel (11) includes a recess (21) extending from the rear edge of the panel, a width (b10) of the recess being substantially the same as a width (b11) of an angled panel section (22) of the upper rigid foam panel (11), a depth (t10) of the recess of the second supporting foam panel (10) being substantially the same as a depth (t11) of the recess of the angled panel section (22).

12. The assembly (1) of claim 11, wherein the first supporting rigid foam panel (9) has a recess (31) extending from the rear edge of the panel, a width (b9) of the recess (31) being substantially the same as the width (b11) of the angled panel section (22), and a depth (19) of the recess (31) being less than the depth (t11) of the angled panel section (22), so that the underside of the angled panel section (22) rests on the first supporting rigid foam panel (9) arranged below it.

13. The assembly (1) of claim 1, further comprising one or more wall mounting brackets (5) for fastening the base body (3) to a wall, the wall mounting bracket(s) (5) forming at least two forwardly projecting swords (4), and wherein the first supporting rigid foam panel (9) includes at least two parallel, elongated sword-receiving recesses (20) extending forwardly from the rear panel edge.

14. The assembly (1) of claim 1, further comprising a drainage device (6) that includes at least one sealing sleeve (28) and a drain (16) for insertion into the drainage opening (15), the sealing sleeve (28) having outwardly facing surfaces and including an adhesion-promoting layer (14) on the outwardly facing surfaces.

15. The assembly (1) of claim 1, wherein an uppermost (11) and a lowermost rigid foam panel (8) of the plurality of rigid foam panels each have a rigid foam core (12), waterproof layers (13) arranged on upper and lower sides of the rigid foam core (12) and adhesion-promoting layers (14) positioned on opposing outer sides.

16. A method of forming a washbasin base body (3), comprising:

arranging a plurality of cut-to-size rigid foam panels (8, 9, 10, 11) one above the other and bonding one to another;

the resultant base body (3) having a top recess (19) having a drainage opening (15) formed therein, a surface of the top recess sloping in the direction of the drainage opening (15);

the resultant base body (3) being formed from rigid foam carrying a waterproof layer (13) at least on its upwardly facing surfaces, on which in turn, an adhesion-promoting layer (14) is arranged which promotes adhesion of thin-bed mortar or filler material.

17. The method of claim 16, wherein the plurality of cut-to-size rigid foam panels (8, 9, 10, 11) have differing geometries prior to bonding them one to another.

18. A washbasin assembly (1), comprising:

a base body (3) formed from at least four cut-to-size rigid foam panels;

the foam panels including at least:

a lower rigid foam panel (8);

a first supporting rigid foam panel (9) arranged atop the lower rigid foam panel;

a second supporting rigid foam panel (10) arranged atop the second supporting rigid foam panel; and an upper rigid foam panel (11);

the upper rigid foam panel (11) including an angled panel (22) section that extends through the first supporting rigid foam panel (9) and through the second supporting rigid foam panel (10) to the lower rigid foam panel (8).

19. The assembly (1) of claim 18, wherein the angled panel section (22) contacts an internal edge formed by cutouts in the first and second supporting rigid foam panels.

20. The assembly (1) of claim 18, wherein a thickness (s8) of the bottom rigid foam panel (8) is greater than a thickness (s9) of the first supporting rigid foam panel (9), which thickness (s9) is greater than a thickness (s10) of the second supporting rigid foam panel (10), which thickness (s10) is greater than a thickness (s11) of the upper rigid foam panel (11).

* * * * *